United States Patent [19]

Nelson

[11] 4,070,085

[45] Jan. 24, 1978

[54] FAST TORQUE DYNA-MATE ATTACHMENT MEANS

[75] Inventor: Fred E. Nelson, Cranston, R.I.

[73] Assignee: General Electric Company, New York, N.Y.

[21] Appl. No.: 737,871

[22] Filed: Nov. 1, 1976

Related U.S. Application Data

[63] Continuation of Ser. No. 572,793, April 29, 1975, abandoned.

[51] Int. Cl.[2] ..... H01R 33/06

[52] U.S. Cl. ..... 339/196 R; 339/103 C; 339/139 C

[58] Field of Search ..... 339/14 P, 103, 107, 339/139, 140, 196, 206, 209; 85/44, 46

[56] References Cited

U.S. PATENT DOCUMENTS

| | | | |
|---|---|---|---|
| 468,543 | 2/1892 | Holt | 85/44 |
| 3,189,865 | 6/1965 | Hawkes | 339/103 E X |
| 3,605,059 | 9/1971 | Lipinski et al. | 339/105 X |
| 3,856,376 | 12/1974 | Poliak et al. | 339/107 |

*Primary Examiner*—Joseph H. McGlynn

*Assistant Examiner*—E. F. Desmond

*Attorney, Agent, or Firm*—Paul E. Rockford; Walter C. Bernkopf

[57] ABSTRACT

A cap and connector device is provided having a great facility in assembly and disassembly for wiring. The rapid assembly is accomplished by separating two halves of the device, namely, a wire terminal portion and a cable clamping portion by removal of fastener members which extend through the wire clamp into the cable clamp portion. The fasteners employed in this device are essentially fastener type devices which have threads set at an acute angle to the fastener axis. The fasteners are also provided with a slotted head to permit use as screws. The separation or unscrewing of the fasteners is accomplished very rapidly because of the acute thread angle, and the parts are thus taken apart very quickly. After the attachment of the cable conductors to the connector terminals has been performed, the two parts are again assembled, and in this case, the fasteners permit a very rapid tightening of the two parts together. In addition, a problem of stripping the threads in the plastic portion of the connector is overcome.

1 Claim, 9 Drawing Figures

FAST TORQUE DYNA-MATE ATTACHMENT MEANS

This is a continuation of application Ser. No. 572,793, filed Apr. 29, 1975, now abandoned.

CROSS REFERENCE TO RELATED APPLICATIONS

This application relates to an article having a similarity to an article claims to which are also filed in copending application of Robert Maloof and Luther Sheldon, Ser. No. 572,794 filed Apr. 29, 1975 application of Melvin Korman, Ser. No. 572,771 filed Apr. 29, 1975.

BACKGROUND

It is known that caps and connectors are commonly used at the ends of flexible cable to supply power of different voltages, amperages, and phases to apparatus on a temporary basis. For example, such power is supplied on a temporary hook-up basis to lighting equipment and various portable machinery and construction site equipment and in other locations where such equipment is used. There are occasions for example when a construction job is started and a reel or a length of cable is obtained and cut to desirable shorter lengths. These custom cut lengths of cable are then equipped with caps and connectors to permit supply of power at various amperages and voltages to various powered equipment used at the construction site to assist in the building operation. The pace at which the devices can be disassembled and attached to the cable and then reassembled is significant because the labor cost of performing these operations at construction sites is relatively high. Accordingly, any saving in the rate at which such attachment can be made is economically beneficial. In addition, it is desirable that the devices, once assembled, be firmly retained to their cable and perform well in their power supply function. Caps and connectors which have been known and used heretofore include those taught in U.S. Pat. No. 3,461,417 assigned to the same assignee as this application, as well as in U.S. Pat. Nos. 3,605,059 and 3,718,890.

Surprisingly, it has been found possible to substantially reduce the time which is needed to attach these caps and connector devices to cables and it has accordingly been found possible to derive thereby significant economic advantage in their use.

Further, it is well known that a single cable having three or four or five wires may be employed in a number of different applications in supplying or carrying power on a temporary basis. For example, power may be supplied at 120 volts or at 220 volts through a given piece of cable. Where the power available is 120 volts that is the power which is employed in a particular application. However, where higher voltage power is available the cable may be employed in temporary supply of the higher voltage power. However, the caps and connectors which are used and can be used in supply of 120 volt power do not have, pursuant to the configurations recommended by the National Electrical Manufacturers Association, the same blade configurations for the power blades used with 220 volt power nor do they have the same connector blade opening configurations. Accordingly, where a set of cables is employed in one fashion and these cables are to be converted by change of their caps and connectors to use at different voltages and/or amperages, the caps and connectors may be removed from the lengths of cable and the alternate caps and connectors may be attached. In such case, it will be evident that the pace and accuracy with which such conversion can be made does involve economic values and that the more rapidly a cap and connector can be changed with a high degree of reliability, the more economically this job can be done.

Further, where such change is to be carried out, there is some concern with being sure that a proper hook up is made, particularly as to ground wires and in the wiring or re-wiring of the caps and connectors of this invention it is not possible to connect the wires improperly so that the cable clamp is made live inasmuch as the cable clamp itself is insulating in contrast with many devices which have been known and used heretofore.

OBJECTS OF THE INVENTION

One object of this invention is to provide a cap and connector which can be quickly assembled to a cable.

Another object is to provide a cap and connector having the capability of being rapidly disassembled for connection of power supply cable thereto.

Another object is to provide a cap and connector construction which has high capability for being disassembled from an existing connection with a cable and for being rapidly reconnected to a different cable.

Another object of this invention is to provide a cap and connector construction which may be manufactured with lower consumption of assembly time and with substantial reliability.

Still another object is to provide a cap and connector construction which permits quick initial disassembly prior to initial wiring and which permits very firm and secure re-assembly particularly with reference to assurance that the wire terminal portion and the cable clamp portion of the cable are securely and firmly connected together.

A further object of the present invention is to provide an improved method by which the wire terminal component and the wire clamping component of caps and connectors may be initially assembled.

Other objects and advantages of the present invention will be in part pointed out and in part apparent in the description which follows.

SUMMARY OF THE INVENTION

A cap and connector are provided capable of more rapid assembly and disassembly of its component elements. Each such device has a wire terminal component to which the wires of a cable being assembled to such a device are connected. Each such device also has a cable clamp component.

The wire terminal component is equipped with a plurality of peripheral unthreaded fastener holes so that fasteners can be mounted to extend through these holes. Unthreaded fastener sockets are provided at matching locations in the cable clamp peripheral portions. When the device is first assembled, the fasteners are driven through peripheral holes of the wire terminal and into the unthreaded sockets and the fasteners are securely fastened into place in this way. The fastener head is slotted to permit rapid disassembly and re-assembly of the fasteners in the respective components of the cap and connector.

In preparation for wiring, the cable clamp component is first disassembled from the wire terminal component. After the wire has been connected to the wire terminal component, this cable clamp component is then assembled to the wire terminal component. The cable clamp is then actuated to form a strain relief grip on the cable.

DESCRIPTION OF THE FIGURES

The following detailed description of the article and method of the present invention will be more clearly understood by reference to the accompanying drawings in which.

DESCRIPTION OF THE PREFERRED EMBODIMENT

Figure 1:
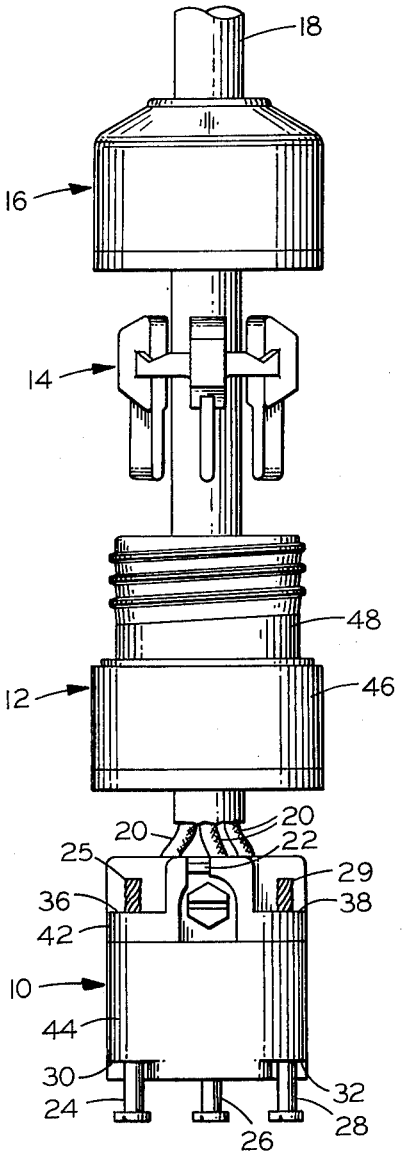
FIG. 1 is an exploded view of a connector and cable clamp prior to assembly of the clamp onto a cable extending therethrough.

Referring to the figures a cap and a connector are shown in various stages of assembly. Referring first specifically to FIG. 1, the connector is made up by assembling together the connector body 10 including a set of fasteners, the lower clamp housing 12, the band of double wedge cleats 14, and the upper clamp housing 16. As illustrated in FIG. 1 the three upper clamp elements 12, 14, and 16 are first threaded onto a cable 18 and the individual conductors 20 are then wired to the respective wire terminals, one of which 22, is shown in the FIG. 1. Three assembly fasteners 24, 26, and 28 extend into respective fastener openings, not shown, in the connector body. The fastener openings extend between the lower external shoulders 30 and 32 and the upper internal shoulders 36 and 38. The connector body 10 itself is made up of an upper wire terminal housing 42 and a lower contact housing 44. The wire terminals and the electrical contacts contained within the body 10 are described more fully in the patent of Luther M. Sheldon, et al., U.S. Pat. No. 3,461,417 assigned to the same assignee as the subject application.

The lower portion 12 of the cable clamp is essentialy tubular in form and has a lower hand grip part 46 and upper threaded part 48. Fastener ports are formed integrally inside the lower part 46 of the clamp element 12 and are positioned to receive the threaded ends 25, 27, and 29 respectively of the fasteners 24, 26, and 28 and are accordingly above the internal shoulders 36, 38, and 40.

The clamp housing 12 also has internal ramps not shown formed integrally on the internal surface of the upper portion 48 and these ramps are located to receive the lower portion of the double wedge gripping cleats of the band of cleats 14. The mechanism for gripping the cable is not part of the invention of this application and is described more fully in copending application of Robert Maloof and Luther Sheldon referenced above.

The upper housing or cover of the clamp housing 16 is provided internally with a surface thread not shown matching the external thread on portion 48 of housing 12 so that the cover may be threaded onto the lower housing and induce the movement of the band of wedged cleats against the cable to form a grip on the cable.

Figure 2:
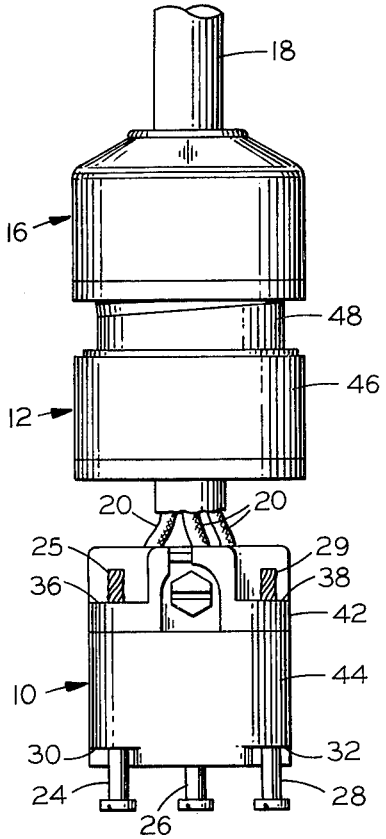
FIG. 2 is an exploded view of the assembled cable clamp prior to assembly to the connector body.
Figure 7:
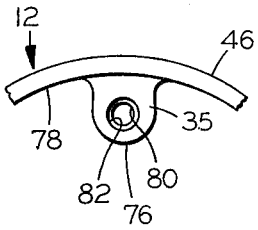
FIG. 7 is a top plan view of a detail of the wall and fastener socket of cable clamp.

After the clamp elements 12, 14, and 16 have been positioned onto the cable 18 and the indivudal conductors 20 are fastened to their associated wire terminals 22, the cable clamp may be assembled. It is shown in the assembled form in FIG. 2. Actually, the cable clamp need not be separated into its several pieces illustrated in FIG. 1, but may be positioned onto the cable 18 in the assembled form illustrated in FIG. 2. This is because the spring properties of the band 14 of double wedge cleats permit the band to expand when the cover 16 is loosened by partial unthreading from the lower clamp housing 12. Accordingly, any clamp element, essentially in the form illustrated in FIG. 2, may be positioned onto the cable prior to the attachment of the individual conductors 20 to the respective wire terminals such as 22. Accordingly, after the wires 20 are attached to the connector body, the clamp may be brought down into the position illustrated in FIG. 3 to abut the internal shoulders not shown of lower housing 12 against the internal shoulders 36 and 38 of connector body 10. The internal shoulder 35 of housing 12 is located at the end of an internal rib such as 76 formed integrally with the internal wall 78 of the lower housing 12 of the cable clamp as best illustrated in FIG. 7. When the respective internal shoulders are aligned, the fasteners 24, 26, and 28 may be tightened to extend through respective screw holes in the walls of connector body 10 and to thread into and seat in the respective screw holes such as 80 in clamp element 12. Accordingly, after the fasteners 24, 26, and 28 are locked into the position shown in FIG. 3, the cover 16 of the cable clamp may be turned to tighten it down toward the lower clamp housing 12 and to urge the double wedge cleats against the cable 18 to provide a strain relief grip of the cable clamp on the cable.

Figure 4:
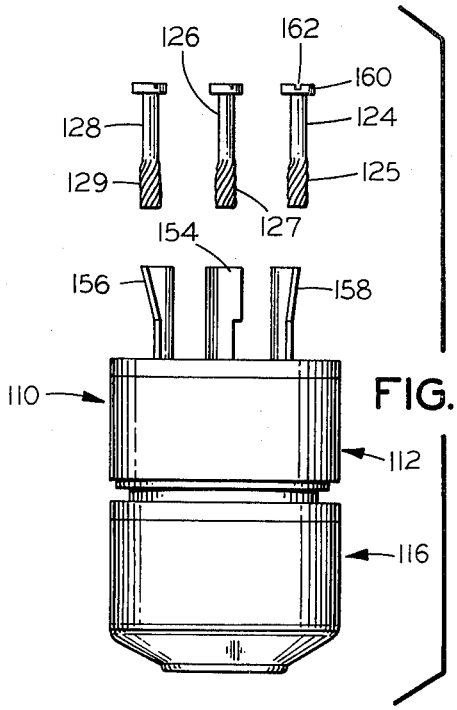
FIG. 4 is a side elevational view of a cap having assembly fasteners poised for mounting into the cap.
Figure 5:
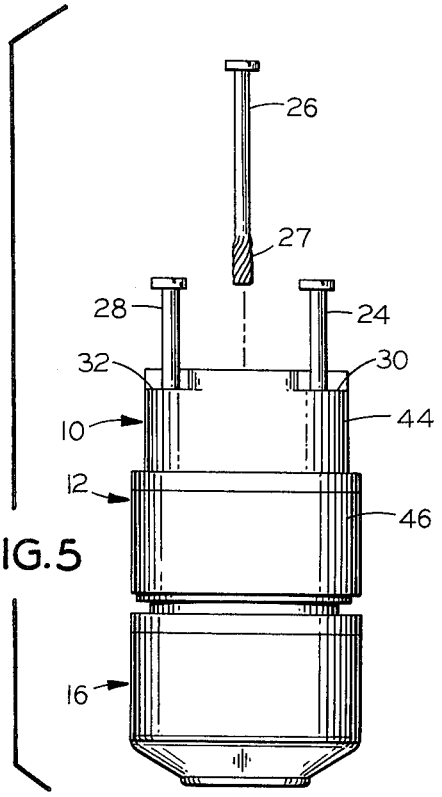
FIG. 5 is a side elevational view of a connector showing the fasteners poised for assembly to the connector.
Figure 6:
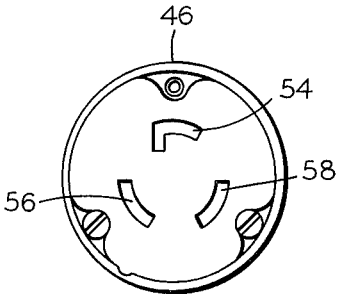
FIG. 6 is a top plan view of a connector as illustrated in FIG. 5, but illustrating two of three fasteners in place.

One advantage of the connector device incorporating the fasteners as provided according to this invention is that the fasteners themselves may be driven into the connector as part of the initial assembly of the connector. This may be done either for a cap as illustrated in FIG. 4 or for a connector as illustrated in FIG. 5. Numerals employed in the description of the cap are essentially the same as those employed in describing the connector with the exception that they are 100 higher than those employed in describing the connector parts as set forth above.

With reference to FIG. 4, three fasteners 124, 126, and 128 are shown poised in their respective positions above a cap or male connector having contact 110. By placing the fasteners in a large bore part such as 182, the respective fastener holes in the cap 110, and the assembly of the contact housing 110 to a clamp 114 can be completed by simply driving the fasteners with a conventional drive mechanism into their respective holes in the cap as explained more fully below.

Similarly, the connectors 24, 26, and 28 may be driven by conventional drive mechanism into the connector body 10 to assemble the body 10 to the clamp element 12 of the connector.

Figure 8:
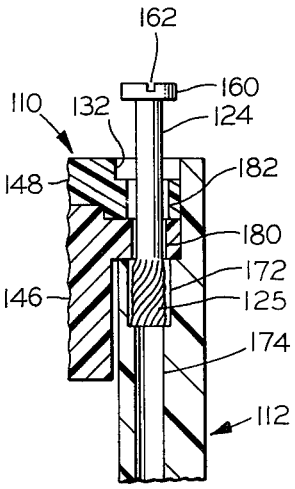
FIG. 8 is a detailed vertical sectional view of a fastener as used in this invention shown in relation to parts of the device it fastens.
Figure 9:
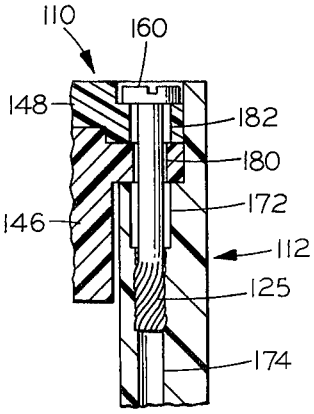
FIG. 9 is a detailed view similar to that of FIG. 8, but illustrating the fastener secured in place.

A more detailed view of the relationships between the fastener such as 124 and the fastener hole in which it is driven is given in FIGS. 8 and 9. The fastener itself has a slotted head 160 provided with slot 162. It also has a non-threaded shank and has a threaded end portion 125. The threads of end portion 125 are not the conventional threads which are found in conventional screw members. Rather, they are formed with a thread having a very steep lead angle and further are formed to extend out beyond the diameter of the shank of the fastener. The threads 125 of the fastener are formed at a very steep angle relative to a conventional machine screw threads of conventional threads which are parts of screws and which are of the self-tapping type. In actual application the fastener is positioned above a recess such as 170 in connector 110 and then placed in a large bore hole 182 in plate 148. Force is applied to the head of the fastener to cause the threads 125 to enter and pass through the hole 180 in part 146 of the connector body 110 and to enter the aligned hole 172 in part 112 of the connector. The threads 125 pass through the oversize hole 172 and into the aligned undersize hole 174. The fastener 124 comes to rest as the head 160 of the fastener 124 comes to rest against the shoulder 132 of body 110. The final position of the fastener 124 once it has been fully driven into place is that illustrated in FIG. 9.

Once the fastener is in place it may be removed by applying a screwdriver to the slot 162 and head 160 of the fastener and rotating the fastener in the conventional fashion to loosen it from its grip in the plastic housing of the cap or connector.

Regarding the character of the fasteners which are employed in connection with this invention, the fasteners themselves are not totally new products. Such products as have been employed heretofor have not, however, been provided with slotted heads and it is the slotted heads which make it possible for them to be employed in the fashion in which screws have been employed heretofore. It is, in fact, rather surprising that these fasteners, which are designed for a single permanent installation in joining two elements together, can in fact be employed as fasteners which can be very conveniently assembled and then subsequently disassembled. More surprising is the fact that after the initial assembly by driving the fastener into place, they can be assembled by use of a conventional screwdriver and then again disassembled and re-assembled numerous times.

A number of features which makes the combination of the fasteners with the connector and clamp quite attractive in the actual handling and manipulation of the device are pointed out.

In the first place, the first hole or fastener port into which the fastener is placed in the cap body or connector body of the device is itself oversize with respect both to the threaded and unthreaded shank portion of the fastener and is in this sense a first oversize well. Accordingly, the fasteners can simply be dropped into these holes or first wells and once dropped in are held or jigged in place to permit them to be driven in by a suitable drive mechanism.

Secondly, there is relatively shallow depth of the plastic of the cap or connector body which is undersize with reference to the threaded portion of the fastener or, in other words, has a diameter which is smaller than the outer diameter of the threaded portion of the fastener. Accordingly, when the fastener is driven through the narrow bore portion of the connector body, it forms a captivating fit which prevents the fastener from falling out of its respective port in the connector body when the connector body is disassembled from the clamp. This narrow bore portion of the cap or connector body fastener port is larger than the unthreaded shank of the fastener, but is smaller than the threaded portion. From FIGS. 8 and 9 it will be seen that the diameter of the threaded portion of the fastener is larger than that of the unthreaded shank.

Thirdly, there is a well of oversized diameter either in the exit portion of the connector body or in the entrance portion of the integrally formed side rib on the interior of the lower clamp housing. This second well permits the fastener, particularly the threaded part of the fastener, to rest in place after it has passed through the connector body and prior to the time when it enters the narrow bore section of the fastener port of the lower clamp housing. What is desirable about this oversize bore portion of the fastener port in a rib of the housing is that the screw can be turned free of threaded contact with the lower housing and still be held captive in the termination part of the connector. This is important as the clamp and connector body are taken apart prior to the wiring operation. Thus, in the initial disassembly of the cap or connector the three assembly screws are turned to loosen them and they back out of their respective fastener ports until they rotate freely in the second oversize well. The clamp can then easily be separated from the remainder of the cap or connector.

Figure 3:
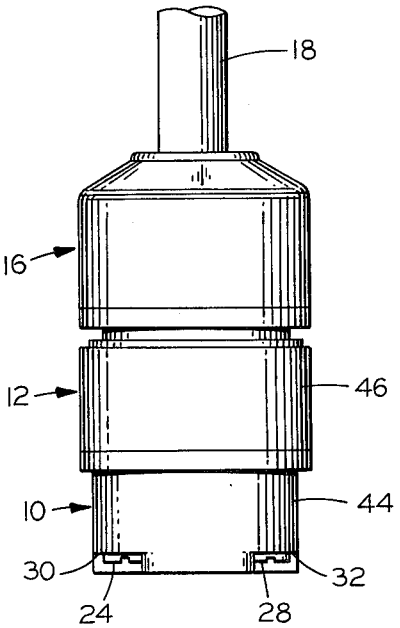
FIG. 3 is an illustration of a fully assembled connector with cable clamp attached.

An important aspect of the fastener configuration is that the fastener should be suitable for being driven directly into its assembled condition as illustrated in FIGS. 3 and 9. For this purpose the fastener port into which the threaded portion of the fastener is first driven and is later threaded should be smaller in diameter than the outer diameter of the threaded portion of the fastener, but not smaller generally than the inner diameter of the threaded portion. By inner diameter of the threaded portion is meant the diameter established by measuring the distance between opposite troughs or valleys of the threads as opposed to the distance between opposite crests of the individual threads. Fasteners which have been found to be excellent in this regard are fasteners which have threads having a lead angle between 45° and 65°. The fasteners may have proportions similar to those illustrated in the figures and in particular a section of threaded surface on the fastener end opposite the fastener head. Such fasteners will undergo one quarter to one half of a turn from the fully fastened position to the fully unfastened position.

While fasteners as described above have been found highly satisfactory in serving as detachable fasteners for and in combination with connector devices, it will be realized that fasteners with other dimensions and dimensional ratios and lead angles as well as length of thread, will be operable in carrying out the present invention without departing from its spirit and scope. For example, fasteners which have threads which have a lead angle of less than 45° or more than 65° can work satisfactorily, although those having angles within this range are preferred. Conventional screws had a lead angle of less than 10° and lead angles in this range are not suitable for use in the combination of the present invention. In fact attempts to use such conventional screws have failed due to stripping of threads of the plastic elements primarily because the depth of engagement of the screw threads is less for a given number of turns of the screw, and to a less significant degree because the threads of conventional screws are more closely spaced so that there is less material to resist the "shearing" force exerted when torquing the screw of the combination of the present invention. Where the thread is at a lower lead angle, a lower of slower assembly and pressing or drive mechanism for driving the fastener into place is preferred in order to avoid tearing the plastic in which the threads are secured.

Since many embodiments of the invention can be made without departing from the spirit and scope of the invention, the foregoing is to be interpreted as illustrative only and not in a limiting sense except as may be requiring by the appended claims. In the claims the term connector is employed in its generic sense as designating both caps and connectors.

I claim:

1. A connector comprising a cable termination having a first insulating plastic housing having an outer wall portion and containing electrical contacts and wire terminals for connection of the wires of the cable which is held in a clamp part of said connector, a cable clamp including a second insulating plastic housing having a cable opening therethrough, said clamp including means for securing said second housing to a cable passing therethrough, said cable termination including a set of peripheral unthreaded fastener ports extending through the outer wall portion of said first insulating housing, and extending through the length of the first housing generally parallel to the axis of the first housing, said cable clamp having a set of unthreaded fastener sockets extending into the second insulated housing thereof at outer wall locations matching and aligned with the outer wall locations at which fastener ports are located in the first insulating cable terminal housing, and fasteners extending through said fastener ports of said first housing into said fastener sockets of said second housing and holding said cable termination housing and said cable clamp housing together, said fasteners having slotted heads to receive tools to apply torque to said fasteners and said fasteners having a non-threaded shank and a threaded end portion with the thread aligned at a lead angle which is steep relative to the lead angles of less than 10° of conventional screws.

* * * * *